US008215137B2

(12) United States Patent
Ripley et al.

(10) Patent No.: US 8,215,137 B2
(45) Date of Patent: Jul. 10, 2012

(54) LAUNDRY APPLIANCE OVER-MOLDED METAL PORTHOLE DOOR FRAME

(75) Inventors: Brian Douglas Ripley, Webster City, IA (US); Lee Allen Roose, Webster City, IA (US); Reynaldo Aramis Nadolny, Webster City, IA (US)

(73) Assignee: Electrolux Home Products, Inc., Charlotte, NC (US)

( * ) Notice: Subject to any disclaimer, the term of this patent is extended or adjusted under 35 U.S.C. 154(b) by 1224 days.

(21) Appl. No.: 11/944,032

(22) Filed: Nov. 21, 2007

(65) Prior Publication Data

US 2009/0126417 A1 May 21, 2009

(51) Int. Cl.

| | |
|---|---|
| ***D06F 17/00*** | (2006.01) |
| ***D06F 37/00*** | (2006.01) |
| ***D06F 39/00*** | (2006.01) |
| *D06F 21/00* | (2006.01) |
| *D06F 23/00* | (2006.01) |
| *D06F 25/00* | (2006.01) |

(52) U.S. Cl. ..... 68/196; 68/139; 68/212

(58) Field of Classification Search ..... 68/196, 68/212, 139; 292/66, 69

See application file for complete search history.

(56) References Cited

U.S. PATENT DOCUMENTS

| | | | |
|---|---|---|---|
| 2,587,645 | A | 3/1952 | O'Neil |
| 3,696,561 | A | 10/1972 | Harp et al. |
| 4,512,494 | A | 4/1985 | Von Holdt |
| 6,198,498 | B1 | 3/2001 | Brickell |
| 6,250,494 | B1 | 6/2001 | Diamond |
| 6,655,047 | B2 | 12/2003 | Miller, II |
| 6,688,064 | B1 | 2/2004 | Swanick |
| 6,862,903 | B2 | 3/2005 | Nitschmann et al. |
| 6,931,761 | B2 | 8/2005 | Hwang |
| 2003/0140596 | A1 | 7/2003 | Bienick et al. |

(Continued)

FOREIGN PATENT DOCUMENTS

| | | |
|---|---|---|
| EP | 0844354 | 5/1998 |

(Continued)

OTHER PUBLICATIONS

International Search Report and International Preliminary Report on Patentability (IPRP-I; identified as "Written Opinion") mailed Mar. 24, 2009 in corresponding PCT Application, International Application No. PCT/US2008/079850.

(Continued)

*Primary Examiner* — Michael Kornakov
*Assistant Examiner* — Katelyn Whatley
(74) *Attorney, Agent, or Firm* — Banner & Witcoff, Ltd

(57) ABSTRACT

A laundry appliance door frame provides an integrated, flame resistant and aesthetic alternative to conventional laundry appliance door frame assemblies, with the benefits of both plastic and metal. The laundry appliance door frame assembly includes a first frame member forming a first peripheral portion of a laundry appliance door about a window pane and a second frame member forming a second peripheral portion of a laundry appliance door about the window pane. The frame members provide a seat to support the window pane on one side and interlocks with reversible hinge and latch components that become part of the frame. Each frame member includes an elongated metal bracket which is at least partially encapsulated within a casing formed of plastic material over-molded onto the metal bracket. The metal brackets form a capture mechanism that provides flame resistant structural support to the side of the window pane opposite the seat.

17 Claims, 7 Drawing Sheets

U.S. PATENT DOCUMENTS

| | | | | |
|---|---|---|---|---|
| 2004/0020073 | A1 | 2/2004 | Lee et al. | |
| 2006/0117809 | A1 | 6/2006 | Ha et al. | |
| 2006/0117813 | A1 * | 6/2006 | Ha et al. | 68/196 |
| 2006/0265899 | A1 | 11/2006 | Renzo | |
| 2007/0075614 | A1 | 4/2007 | Calmeise | |

FOREIGN PATENT DOCUMENTS

| | | | | |
|---|---|---|---|---|
| EP | 844354 | A1 | * | 5/1998 |
| EP | 1685786 | | | 8/2006 |
| FR | 2823789 | A1 | | 10/2002 |
| GB | 2070130 | | * | 9/1981 |
| GB | 2070130 | A | * | 9/1981 |
| WO | 2005014913 | | | 2/2005 |
| WO | WO 2005014913 | A1 | * | 2/2005 |

OTHER PUBLICATIONS

EPO Communication pursuant to Rules 161(1) and 162 EPC dated Jul. 13, 2010 in corresponding EP Application No. 08852462.4-2314 PCT/US2008/079850.

Aug. 18, 2010 Response of Applicant Electrolux Home Products, Inc. to Jul. 13, 2010 EPO Communication in corresponding EP Application No. 08852462.4-2314 PCT/US2008/079850.

Design News for Mechanical and Design Engineers, Seimens PLM Software article, Whirlpool Innovates with ABS Overmold, Aluminum Door Trim Ring Inserts, Doug Smock, Contributing Editor, May 14, 2007.

* cited by examiner

LAUNDRY APPLIANCE OVER-MOLDED METAL PORTHOLE DOOR FRAME

FIELD OF THE INVENTION

The present invention relates generally to improving the frame assembly of laundry appliance doors. In particular, the invention concerns laundry appliance door frame assemblies with improved strength, flame resistance and aesthetics.

BACKGROUND

In a modern trend, laundry appliances are taking on a more visually prominent role in the home, serving as statement pieces reflecting individual style. Consequently, the aesthetics of the laundry appliance is an important factor in the design of a laundry appliance and its components. For example, it is desirable to provide a laundry dryer door construction which is consistent with, or complimentary of, the accompanying washer door construction, which may be constructed with plastic components, as well as to provide laundry dryer door parts which have a "look and feel" which is consistent with, or complimentary of, each other and/or other parts of the dryer, which may be constructed of plastic.

Conventional laundry appliances generally include a frame assembly constructed of either steel or plastic. Steel is the most flame resistant of the materials typically used. However, steel has several disadvantages as a construction material for an appliance door. For example, a single thickness generally is not suitable to increase the overall strength and rigidity of the door construction, due to the excessive weight. Steel is also limited by its formability, which constrains the door construction geometry. To decorate and provide rust resistance, steel requires secondary operations (e.g., paint). Even then, a steel door may not optimally match portions of a washer or dryer that are constructed of plastic.

In comparison to steel, plastic is more versatile. A plastic door can readily be constructed with variable wall thickness and geometry to provide interlocking features and overall door rigidity. Plastic does not rust, and a plastic door can provide a better aesthetic match with other plastic components of the associated laundry appliances. The main disadvantage to plastic is that it is not flame-resistant like steel. Therefore, in the event of a fire, for example in a laundry dryer, a plastic door may burn or otherwise lose its structural integrity. If this happens, the door cannot reliably contain flames inside the drum, or maintain a barrier shielding a user from exposure to any excessive heat or flames within the appliance drum.

Laundry appliances with frame assemblies comprising separately formed and adjoined plastic and metal structures have been proposed. For example, U.S. Application Publication No. 2006/0265899 (Renzo), discloses a clothes dryer door assembly including a metal inner frame, an outer mask frame, and an outer window of plastic material. U.S. Application Publication No. 2004/0020073 (Lee et al.), proposes a laundry dryer top cover assembly that uses a flame resistant plate secured under a separate plastic top cover to provide both an aesthetically pleasing exterior of the dryer body and a flame resistant internal cabinet. A need remains for an integrated door frame assembly that provides the advantages of both steel and plastic, particularly one of the porthole variety suitable for use in a laundry appliance.

BRIEF SUMMARY OF SELECTED INVENTIVE ASPECTS

Laundry appliance door frame assemblies in accordance with aspects of the present invention can provide an integrated, flame resistant and aesthetic alternative to conventional laundry appliance door frame assemblies.

In accordance with an aspect of the invention, frame members of a laundry appliance door frame assembly include an elongated metal bracket partially encapsulated within a casing formed of plastic material over-molded onto the bracket.

Such an arrangement can advantageously be used to provide a door frame of relatively thin cross section, and to provide the frame members of the laundry appliance door frame assembly with the advantages of both plastic and steel. Additionally, since the plastic over-molding can be configured to variable thicknesses, such a configuration can provide the integrated door frame members with increased rigidity and a capability to interlock with other door frame components, including door hinge and latch components (that may themselves form portions of the frame).

The elongated metal brackets included in the over-molded frame members provide a structural integrity that persists independent of the structural integrity of the bracket's over-molded casing, thus facilitating the provision of an appliance construction capable of flame containment, while allowing greater flexibility regarding material choices to obtain a desired "look and feel."

The elongated brackets can provide support to one or both sides of a viewing window. Because of the elongated brackets' independent structural integrity, the appliance door assembly, which may include a tempered glass viewing window, can remain intact in the event of flames or excessive heating occurring within the appliance.

In a further aspect, the frame members include interlock portions configured to interlock the laundry appliance door frame assembly with a door hinge component and/or door latch component interchangeably. In accordance with this aspect, the placement of the door hinge and door latch can be reversed to change the pivot position and swing of the appliance door with respect to the body of the appliance.

The above and other objects, features and advantages of the present invention will be readily apparent and fully understood from the following detailed description of preferred embodiments, taken in connection with the appended drawings.

DETAILED DESCRIPTION OF EXEMPLARY EMBODIMENTS

Figure 1:
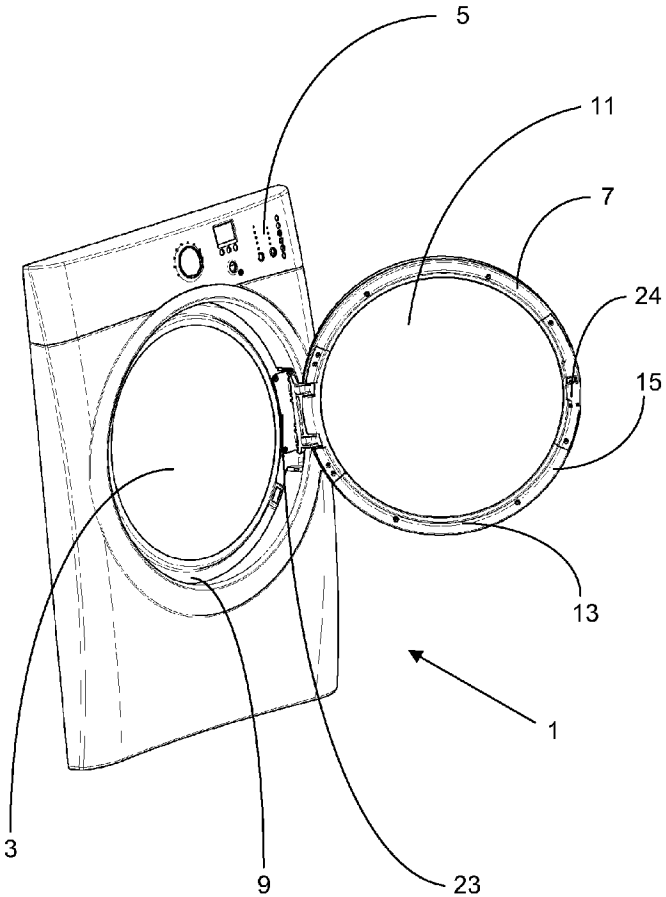
FIG. 1 is a front perspective view of one embodiment of a laundry appliance front panel including an appliance door frame assembly in accordance with an aspect of the present invention.

Referring to FIG. 1, a laundry appliance (e.g., dryer) front panel 1 includes an access opening or porthole 3, a control panel 5 for controlling the appliance operation, and a hinged laundry appliance door 7 that may be swung open to provide front-load access to a rotatable drum-type drying chamber, through the porthole 3. The appliance front panel 1 may be secured to a front bulk-head of the appliance that may serve to rotatably support the front end of the appliance drum. This assembly may include a door seat portion 9, including a sealing gasket surrounding porthole 3, against which the appliance door 7 presses when closed.

Laundry appliance door 7, illustratively provided in the form of a circular porthole cover, includes a viewing window 11, and a door frame assembly that includes inner frame member 13 and outer frame member 15, a door hinge component 23, and a door latch component 24. As will be described in further detail, inner frame 13 includes interlocked plastic over-molded metal members that allow the appearance of the door's inner frame to have generally the same look and feel as the door's outer frame member 15, which may be constructed of plastic material, and/or to match or compliment the aesthetics of a door of a companion laundry appliance (not shown), which may also be constructed of plastic material.

Figure 2:
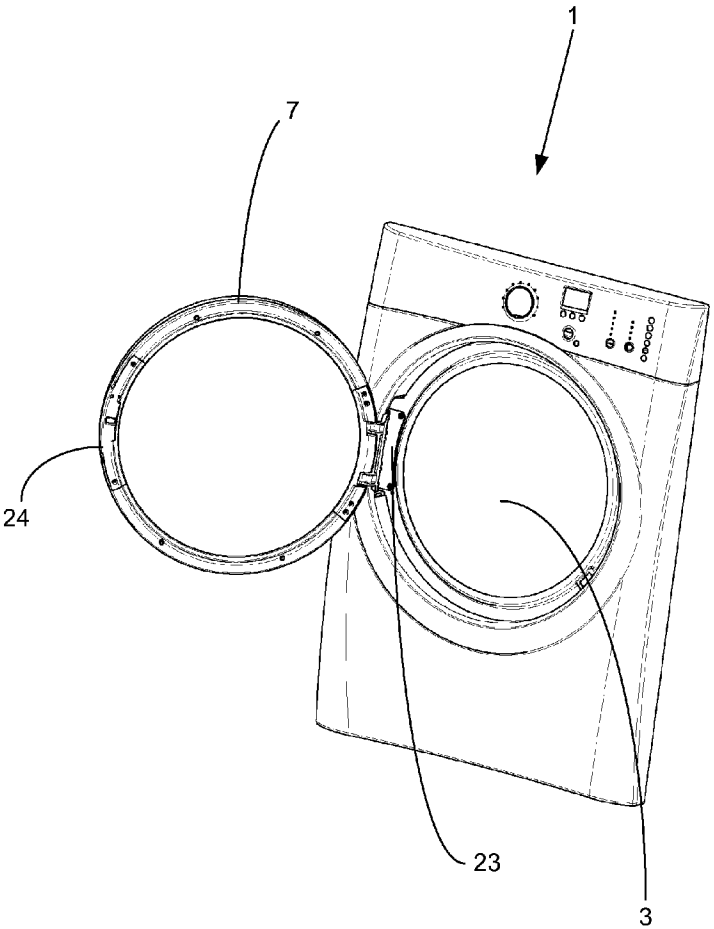
FIG. 2 is a front perspective view of the laundry appliance front panel shown in FIG. 1, with the appliance door frame assembly mounted on an opposite side of the access opening.

In FIG. 2, the laundry appliance door 7 is shown attached to the appliance front panel 1 at an alternative pivot position, on the opposite side of the porthole 3. A door frame assembly in accordance with invention can facilitate such hinge and latch reversibility, by providing a seating and interlock structure capable of mounting a hinge and latch structure in a reversible fashion on opposite sides of the door frame.

Figure 3:
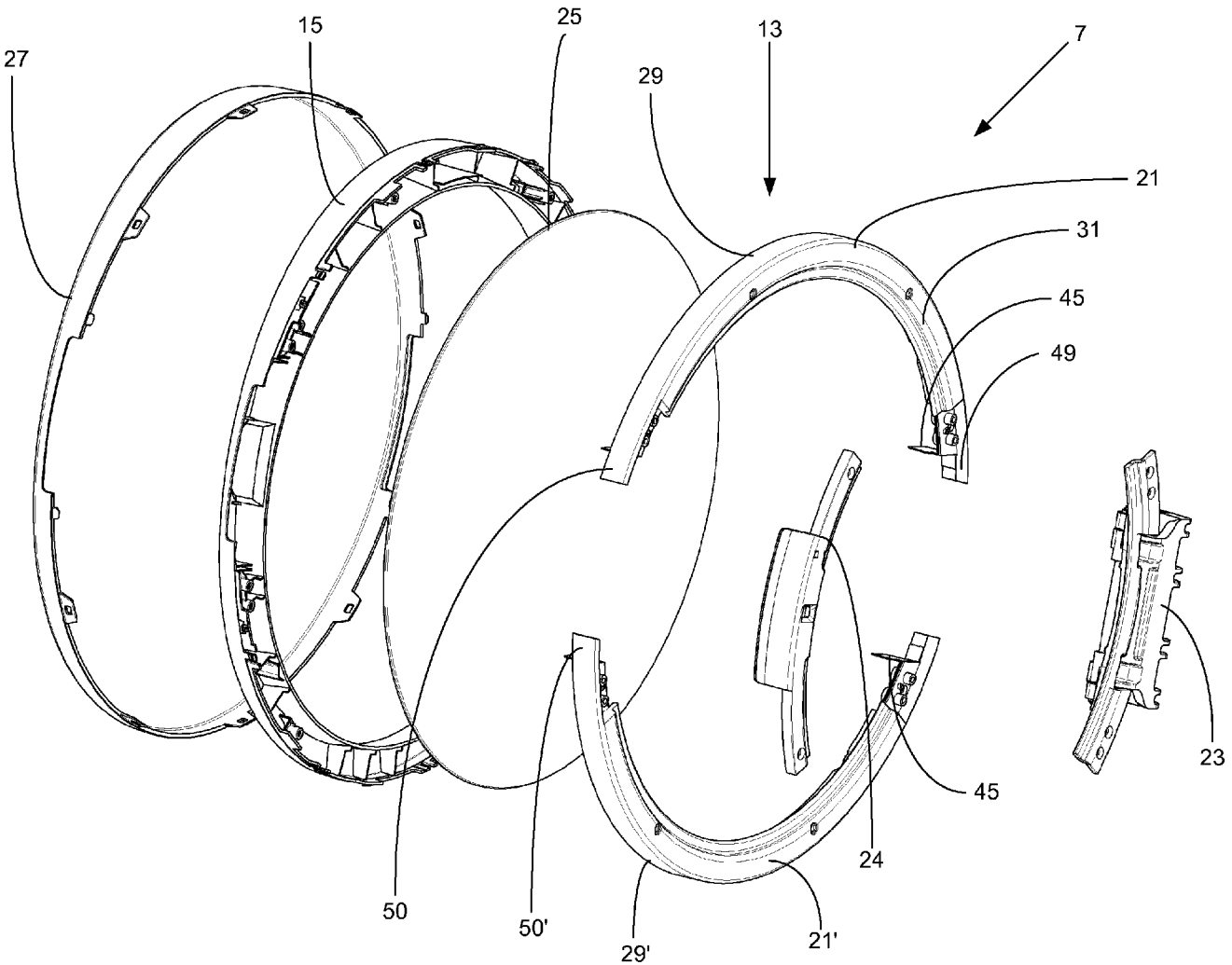
FIG. 3 is an exploded perspective view of one embodiment of the laundry appliance door frame assembly seen in FIGS. 1-2.

An exemplary embodiment of the laundry appliance door assembly 7 is shown in more detail in the exploded view of FIG. 3. The laundry appliance door 7 includes semi-circular frame members 21 and 21', which form segments of the laundry appliance door's inner frame 13. The assembly further includes door hinge component 23 and door latch component 24. The viewing window 11 generally referenced in connection with FIGS. 1 and 2 may be a double pane window comprising an internal circular window pane 25, preferably formed of flame-resistant tempered glass, and an exterior window pane or cap 27, which may be formed of transparent or translucent plastic material (optionally tinted). The assembly further comprises the outer frame 15, that may be provided in the form of a single piece circular ring of molded plastic material, onto which exterior window pane or cap 27 may be snap-fit.

Illustrative frame members 21 and 21' are identical and are, in the frame assembly arranged in mirror-image relation to each other. Representative frame member 21 has an outer peripheral edge surface 29 and an adjoined circumferentially extending web portion 31 on the radially inward side. As seen in FIG. 4 and FIGS. 5A-D, representative frame member 21 is formed by over-molded plastic 33 substantially encapsulating an elongated metal bracket 35 extending in a corresponding semi-circular arc and having corresponding orthogonally arranged web and edge portions 37, 39 respectively. The web 37 is a flat portion extending circumferentially and generally parallel to the plane of the window 25 and the edge 39 is a flange that extends circumferentially along and orthogonally with respect to the flat portion. The metal-reinforced web portions provide structural strength and stiffness to the frame. The brackets may be stamped or otherwise formed of steel or other suitable material, preferably corrosion resistant (e.g. stainless or galvanized steel).

Figure 4:
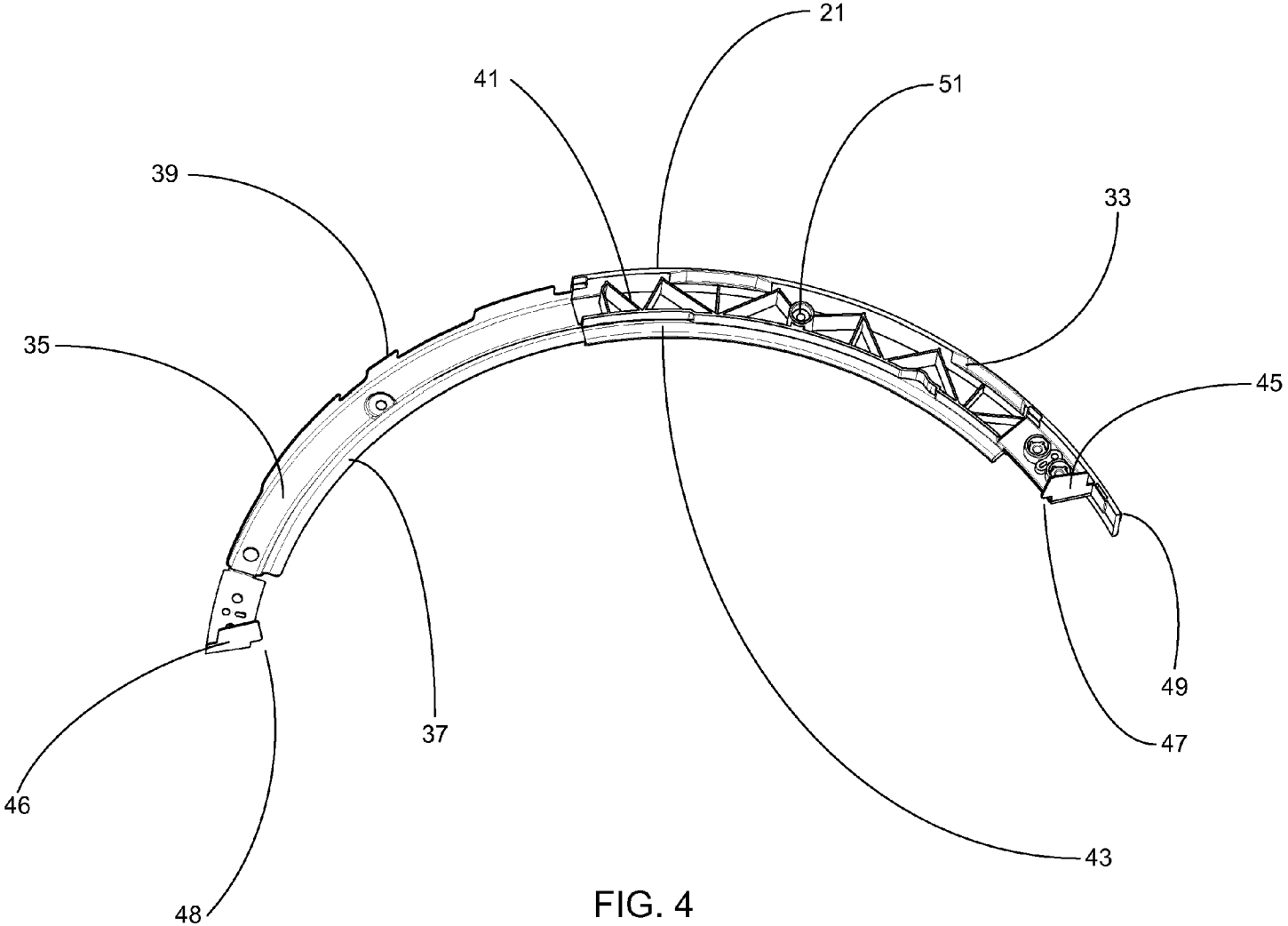
FIG. 4 is a perspective view of an over-molded frame member of the laundry appliance door frame assembly, partially broken away to reveal a portion of the frame member's elongated internal metal bracket.

In addition, referring to FIG. 4, it can be seen that these portions comprise, on their outwardly facing sides (the sides facing to the outside of the appliance), integrally molded reinforcement ribbing 41 and, radially inward thereof, a seat portion that provides a seat 43 against which a periphery of the inner window pane 25 may rest and be supported on one side. Upon assembly, window pane 25 is captured and held in the seat 43 by support tabs 45, 46 provided at the opposite ends of the respective frame members. As illustrated, these tabs 45, 46 are provided, as exposed (non-over-molded) ends of the metal brackets. These metal tabs 45, 46 lend structural support to the side of the window glass opposite that seated on seat portion 43. Therefore, the tabs 45, 46 serve, in conjunction with the seat portion 43, to securely capture the glass 25 within the assembled inner frame 13. As illustrated in FIGS. 4 and 6B-D, the representative tabs 45, 46 extend orthogonally to the plane of the arc of the metal bracket toward the outside of the door assembly 7 and further includes a recess 47, 48 on an inside edge forming a capture mechanism for securely holding the glass 25 in place in its seat portion 43. In addition, the tabs 45, 46 provide abutment surfaces for mating with end surfaces of hinge and latch components 23, 24 as best seen in FIG. 3. In the event that flames or excessive heat that might occur in a laundry appliance, for example a dryer, the flames could destroy or weaken the plastic material of the plastic over-molding and other plastic components of the door (including, in some embodiments the plastic outer door frame). However, the structural integrity of the interlocked frame member, and the tempered glass secured therein, should persist, to thereby contain any flames inside the drum and maintain a barrier between the appliance drum and any person or objects outside of the malfunctioning appliance.

It will be appreciated from FIG. 3 that each frame member 21, 21' forms less than one half of the circular shape of the frame assembly extending about window pane 25. Segments of the circle of the frame assembly are formed by the hinge and latch components 23, 24, respectively. Each of these is, in the illustrated embodiment, interlocked between the frame members 21, 21' (on opposite sides) and configured as arcuate frame continuation segments. Like the frame members 21, 21', each includes a web portion providing, on an inwardly facing side, a seat surface against which a peripheral surface portion of window pane 25 may be supported. Exposed ends of the partially (largely) encapsulated metal brackets located adjacent to the glass capturing tabs 45, 46, provide seats to which the ends of the arcuate frame continuation segments formed by the hinge and latch components 23 and 24 respectively may be mounted and secured. In the exemplary embodiment, the arcuate continuation frame segments and associated hinge/latch structures are formed of cast corrosion-resistant metal, e.g., aluminum, or other suitable material. The hinges and latches 23 and 24 respectively, are joined with the frame pieces 21, 21' by metal-to-metal contact, to thereby provide structural integrity even in the event of flames which destroys or weakens the plastic components and over-molding of the door frame. Securement of the hinge/latch component continuation frame segments to the primary frame segments 21, 21' may be effected through use of conventional fasteners, e.g., screws or bolts, passing through holes provided in the seats formed by the exposed metal bracket ends, and overlapping end portions of the continuation frame segments.

Figure 5:
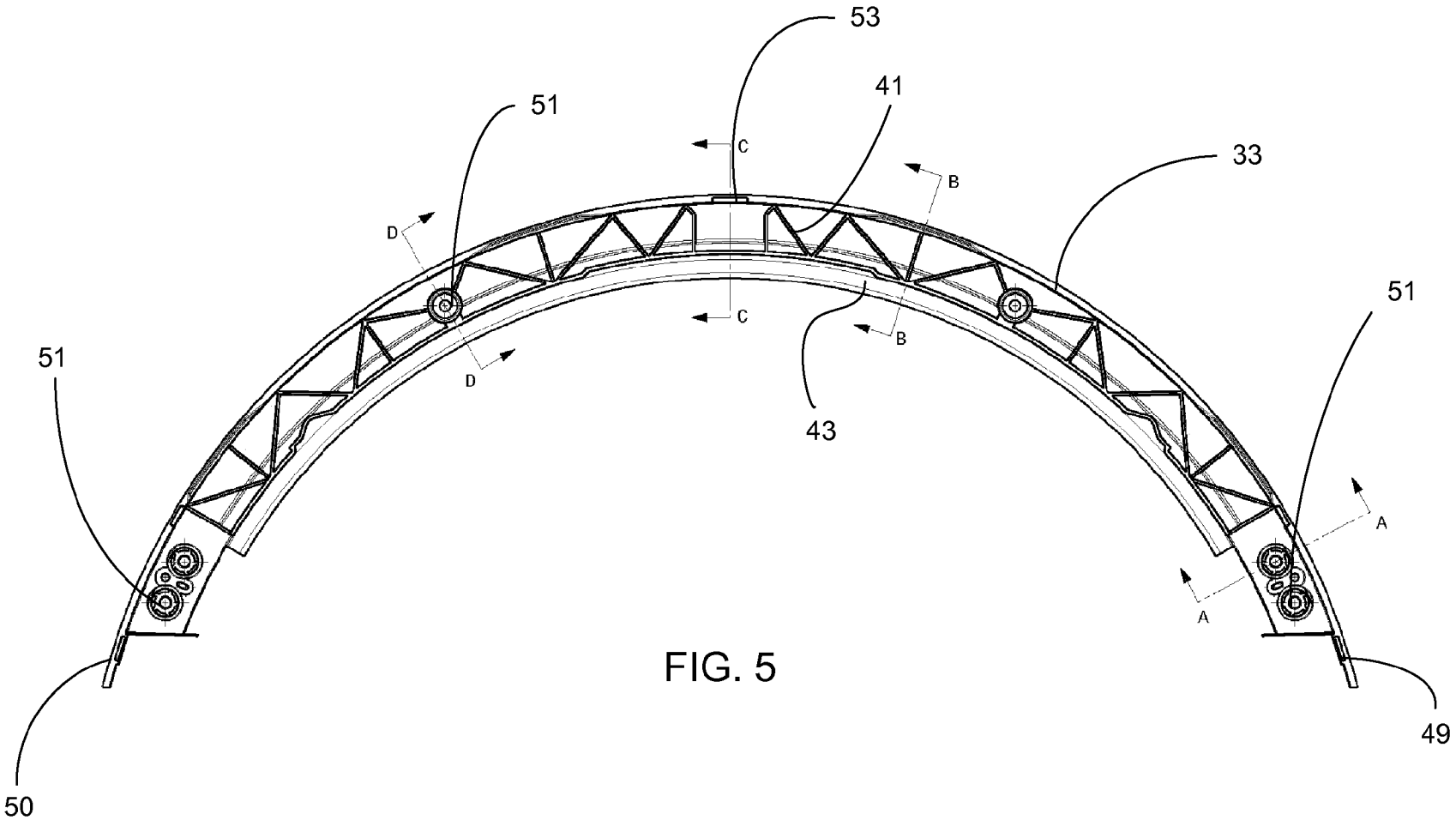
FIG. 5 is a front side elevation view of the over-molded frame member shown in FIG. 4.
Figure 5D:
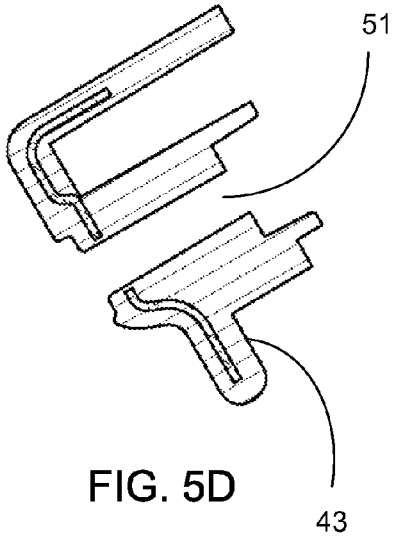
FIGS. 5A-D are various cross-sectional views taken along the over-molded frame member shown in FIG. 5 at the correspondingly labeled section lines.
Figure 5C:
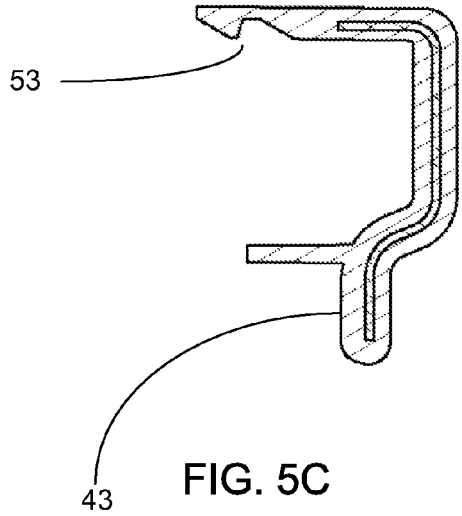
Figure 5B:
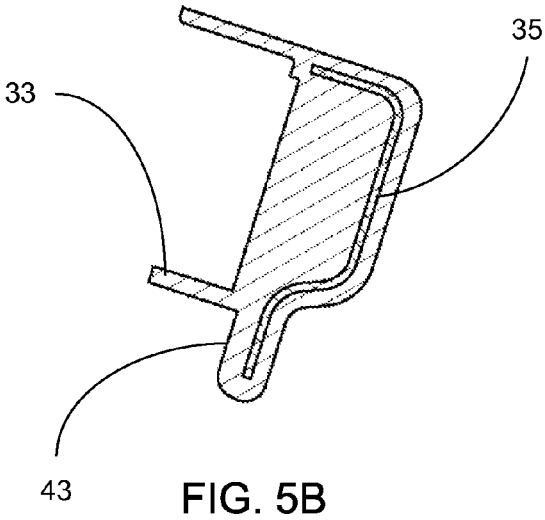
Figure 5A:
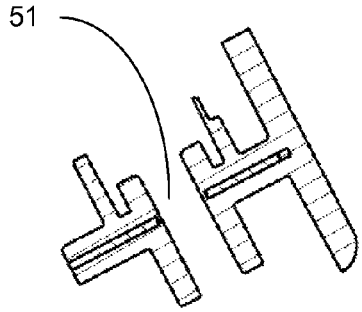
Figure 6A:
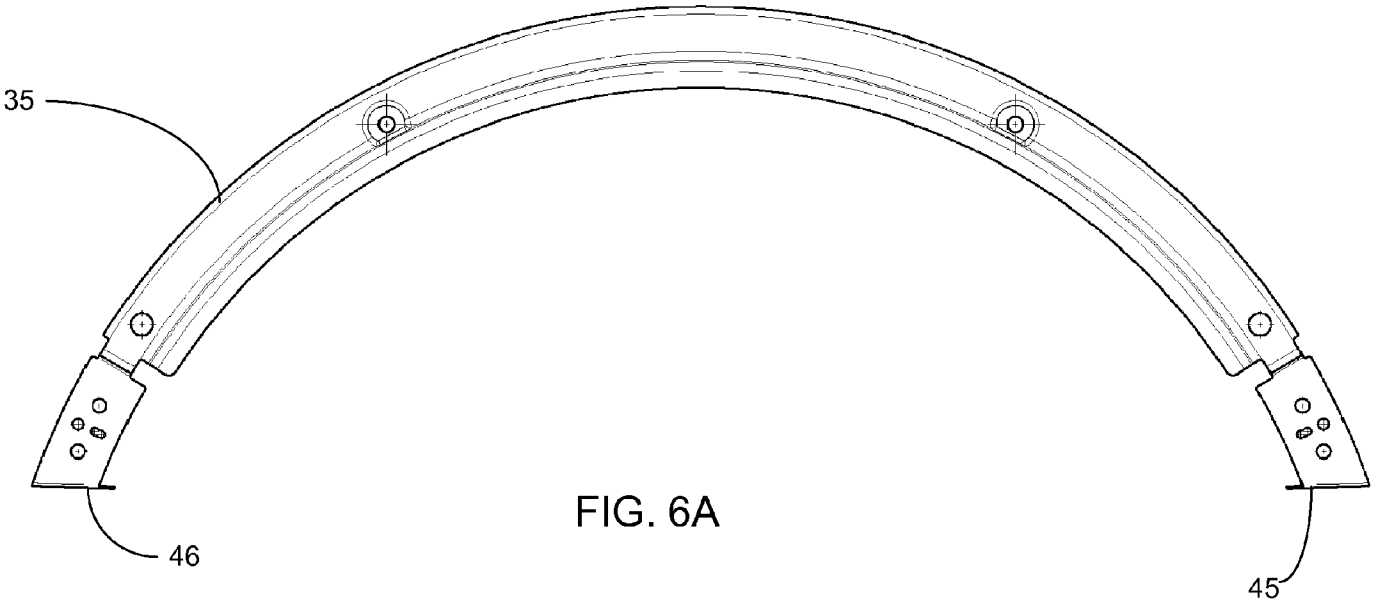
FIG. 6A is a front view of the metal bracket comprising part of the frame member shown in FIG. 5.
Figure 6B:
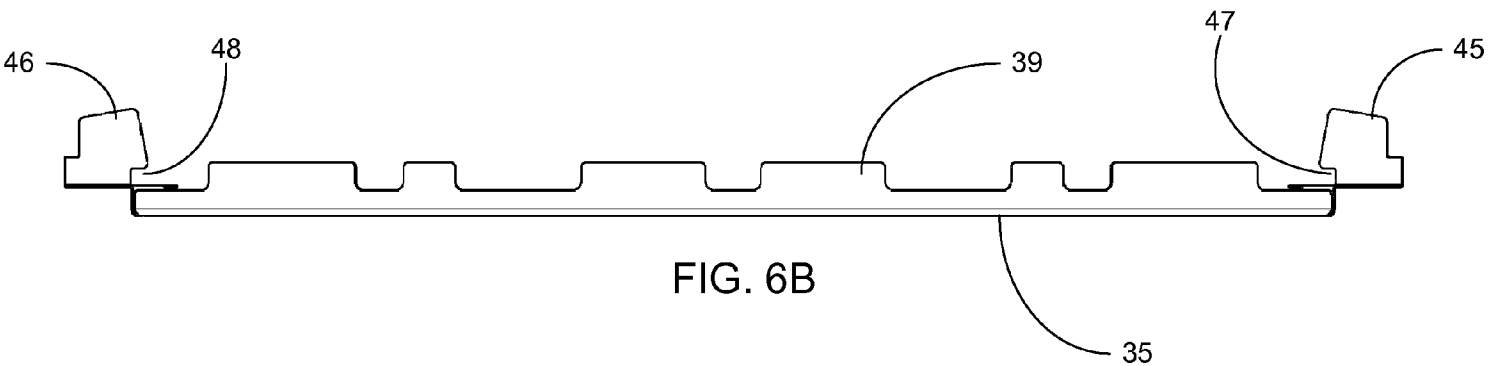
FIG. 6B is a bottom view of the inside of the metal bracket shown in FIG. 6A.
Figure 6C:
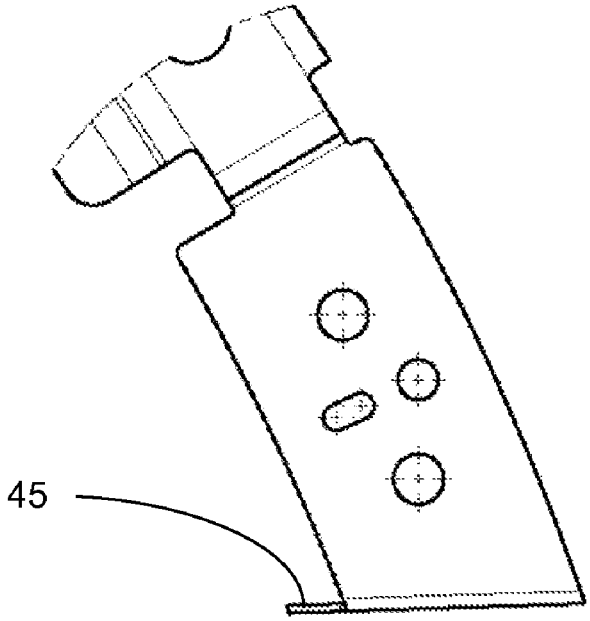
FIG. 6C is a detailed view of an exposed end of the frame member shown in FIG. 6A.
Figure 6D:
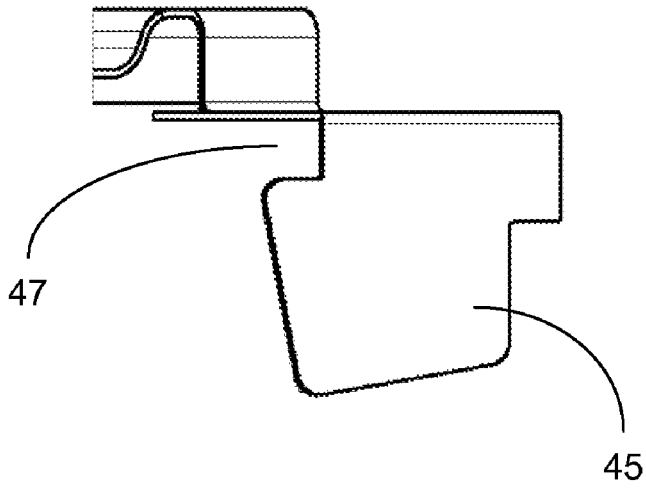
FIG. 6D is a partial front view of the exposed end of the frame member shown in FIG. 6C.

When both hinge component 23 and latch component 24 are interlocked with/between the frame members 21, 21', the inner door frame 13 of the illustrated embodiment forms a circular ring or annulus including a substantially continuous peripheral edge surface 29, 29' and a web portion 31 defining recessed glass-supporting seat 43. A flush fit of the hinge and latch continuation frame segments in the overall assembly is further enhanced by overhanging extensions 49, 50 of the peripheral edge surface 29 formed as part of the over-molded plastic pieces 33. These extensions abut flushly with each other and overlie corresponding frame continuation surfaces of the hinge and latch. In addition, in the illustrated embodiment, the plastic over-molding forms bosses 51 at spaced locations along the frame member provided in alignment with corresponding holes in the metal brackets and serving as mounting locations for screws, bolts or other appropriate fasteners used to attach the inner door frame assembly 13 to outer door frame 15. In addition, as best seen in FIGS. 5 and 5D, the over-molding 33 may provide the frame members with snap-clip tabs 53 at spaced locations for engaging with the outer door frame 15.

In another embodiment the inner door frame 13 comprises a single plastic over-molded elongated metal bracket that forms a complete closed circle. According to one aspect of the invention, in such an inner door frame 13, the single elongated metal bracket may include the hinge component 23 and the latch component 24, or provide mounting locations for separately formed hinged and latch components to be attached.

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. A laundry appliance door frame assembly, comprising:

a window pane; and a first frame member forming a first peripheral portion of a laundry appliance door about said window pane; said frame member comprising an elongated metal bracket, said metal bracket being at least partially encapsulated within a casing formed of plastic material over-molded onto the metal bracket, said metal bracket being configured to provide structural support to at least one of opposing sides of the window pane, said plastic material over-molded onto the metal bracket extending along and at least partially covering both inwardly and outwardly facing sides of said bracket, as well as inner and outer circumferential edge portions of said bracket.

2. The assembly of claim 1, further comprising, a second frame member forming a second peripheral portion of the laundry appliance door about said window pane, said second frame member comprising a second elongated metal bracket, said second metal bracket being at least partially encapsulated within a second casing formed of plastic material over-molded onto the second metal bracket, said second metal bracket being configured to provide structural support to at least one of the opposing sides of the window pane.

3. The assembly of claim 2, wherein a circumferential end portion of each metal bracket extends outside of said casing.

4. The assembly of claim 2, wherein each said casing comprises reinforcing ribbing along a substantial portion of the length of the respective metal bracket.

5. The assembly of claim 2, wherein each frame member further comprises at least one interlock portion configured to interlock the frame assembly with at least one of a door hinge component and a door latch component.

6. The assembly of claim 5, wherein each casing extends beyond its associated metal bracket to define an overhang casing portion at an end of the metal bracket, said overhang casing portion abutting flushly with an opposite overhang portion of the other frame member and overlying a surface portion of a corresponding said door hinge component or door latch component.

7. The assembly of claim 2, wherein the first and second frame members are coupled with each other through an intermediate hinge component and an intermediate latch component, so as to form a closed loop.

8. The assembly of claim 7, wherein the first and second frame members are identical and coupled with each other through the intermediate hinge and latch components in substantial mirror-image relation.

9. The assembly of claim 7, wherein the positions of said hinge component and latch component are interchangeable so as to reverse an opening direction and mounting location of the door on the appliance.

10. The assembly of claim 3, wherein each frame member comprises a circumferentially extending recessed surface providing a seat for supporting a peripheral edge portion of the window pane; and wherein the circumferential end portion of each metal bracket that extends outside of said casing comprises a tab on at least one end thereof, said tab being configured such that the window is captured by the seat on one side of the window, and the metal tab on the opposite side.

11. The assembly of claim 1, wherein said frame member is part of a laundry appliance door inner frame assembly, said assembly further comprising an outer appliance door frame member, said assembly further comprising at least one securing member for securing said inner frame assembly of said outer appliance door frame member.

12. The assembly of claim 11, further comprising an outer window panel attached to the outer door frame assembly.

13. The assembly of claim 2, wherein each metal bracket comprises a flat portion extending circumferentially and parallel to the plane of the window, and an outer flange that extends circumferentially along, and orthogonally with respect to, the flat portion.

14. The assembly of claim 2, wherein the window pane is a circular window pane and each frame member extends in a circular arc about a peripheral portion of the window pane.

15. The assembly of claim 2, wherein said frame members are part of a laundry appliance door inner frame assembly, said assembly further comprising an outer appliance door frame member, said assembly further comprising at least one securing member for securing said inner frame assembly to said outer appliance door frame member.

16. A laundry appliance door frame assembly, comprising:

a window pane;

a first frame member forming a first peripheral portion of a laundry appliance door about said window pane; said frame member comprising an elongated metal bracket, said metal bracket being at least partially encapsulated within a casing formed of plastic material over-molded onto the metal bracket, said metal bracket being configured to provide structural support to at least one of opposing sides of the window pane; and a second frame member forming a second peripheral portion of the laundry appliance door about said window pane, said second frame member comprising a second elongated metal bracket, said second metal bracket being at least partially encapsulated within a second casing formed of plastic material over-molded onto the second metal bracket, said second metal bracket being configured to provide structural support to at least one of the opposing sides of the window pane;

wherein:

a circumferential end portion of each metal bracket extends outside of said casing;

each frame member comprises a circumferentially extending recessed surface providing a seat for supporting a peripheral edge portion of the window pane; and the circumferential end portion of each metal bracket that extends outside of said casing comprises a tab, said tab being configured such that the window is captured by the seat on one side of the window, and the metal tab on the opposite side.

17. A laundry appliance door frame assembly, comprising:

a window pane; and a first frame member forming a first peripheral portion of a laundry appliance door about said window pane; said frame member comprising an elongated metal bracket, said metal bracket being at least partially encapsulated within a casing formed of plastic material over-molded onto the metal bracket, said metal bracket being configured to provide structural support to at least one of opposing sides of the window pane;

wherein:

a circumferential end portion of the metal bracket extends outside of said casing;

said first frame member comprises a circumferentially extending recessed surface providing a seat for supporting a peripheral edge portion of the window pane; and the circumferential end portion of the metal bracket that extends outside of said casing comprises a tab, said tab being configured such that the window is captured by the seat on one side of the window, and the metal tab on the opposite side.

* * * * *